US012276464B2

(12) United States Patent
Miyata et al.

(10) Patent No.: US 12,276,464 B2
(45) Date of Patent: Apr. 15, 2025

(54) COMPRESSOR MODULE AND COMPRESSOR MODULE DESIGNING METHOD

(71) Applicant: MITSUBISHI HEAVY INDUSTRIES COMPRESSOR CORPORATION, Tokyo (JP)

(72) Inventors: Hiroyuki Miyata, Hiroshima (JP); Masahiro Kobayashi, Hiroshima (JP); Kazutoshi Yokoo, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/650,272

(22) Filed: Feb. 8, 2022

(65) Prior Publication Data

US 2022/0268526 A1 Aug. 25, 2022

(30) Foreign Application Priority Data

Feb. 25, 2021 (JP) ..... 2021-028518
Oct. 6, 2021 (JP) ..... 2021-164590

(51) Int. Cl.
*F28D 7/00* (2006.01)
*F25B 1/10* (2006.01)
(Continued)

(52) U.S. Cl.
CPC ..... *F28D 7/0091* (2013.01); *F25B 1/10* (2013.01); *F25B 6/04* (2013.01); *F25B 39/04* (2013.01); *F28F 2250/08* (2013.01)

(58) Field of Classification Search
CPC ..... F04D 29/5826; F04B 39/06; F25B 1/10; F25B 6/04; F25B 39/04; F28D 7/0066;
(Continued)

(56) References Cited

U.S. PATENT DOCUMENTS 3,001,692 A * 9/1961 Schierl ..... F04D 25/163 415/199.1
2003/0021701 A1* 1/2003 Kolodziej ..... F04D 29/5826 417/243

(Continued)

FOREIGN PATENT DOCUMENTS

CN 204140500 U 2/2015
DE 102014211950 A1 12/2014

(Continued)

*Primary Examiner* — Eric S Ruppert
*Assistant Examiner* — Hans R Weiland
(74) *Attorney, Agent, or Firm* — Osha Bergman Watanabe & Burton LLP

(57) ABSTRACT

A compressor module includes: a compressor; and a high-pressure gas cooler which cools gas discharged from the compressor, wherein the high-pressure gas cooler includes a plurality of gas cooler partial bodies, wherein each gas cooler partial body includes a high-pressure casing which is formed in a cylindrical container shape extending in a horizontal direction and to which the gas is introduced and a high-pressure heat exchange unit which is installed in the high-pressure casing and cools a gas passing in one direction orthogonal to a center axis of the high-pressure casing, and wherein the gas cooler partial bodies are arranged in parallel so that the center axes of the high-pressure casings are parallel to each other, the gas sequentially flows through the gas cooler partial bodies.

7 Claims, 7 Drawing Sheets

(51) Int. Cl.
*F25B 6/04* (2006.01)
*F25B 39/04* (2006.01)

(58) Field of Classification Search
CPC ..... F28D 7/0075; F28D 7/0091; F28D 2021/0068; F28D 2021/0073; F28F 2250/08
See application file for complete search history.

(56) References Cited

U.S. PATENT DOCUMENTS

2003/0059299 A1* 3/2003 Miura ..... F04D 29/5826 415/122.1
2007/0215330 A1* 9/2007 Umetsu ..... F28F 1/325 165/151
2007/0220915 A1* 9/2007 Heyl ..... F25B 9/008 62/324.1
2009/0158762 A1* 6/2009 Eber ..... F25B 39/04 62/196.4
2012/0027627 A1 2/2012 Getze
2013/0183146 A1* 7/2013 Minegishi ..... F04D 29/063 415/177
2015/0000867 A1 1/2015 Oba et al.
2015/0007968 A1* 1/2015 Shin ..... F28D 7/0066 165/157
2016/0187893 A1* 6/2016 Bergh ..... G05D 16/2046 137/565.11
2017/0370649 A1* 12/2017 Shin ..... F28B 7/00
2018/0017082 A1 1/2018 Park
2019/0093672 A1* 3/2019 Saburi ..... F28D 7/16

FOREIGN PATENT DOCUMENTS

JP 2003-328998 A 11/2003
JP 2013-060882 A 4/2013
KR 10-2013-0029022 A 3/2013
KR 10-2018-0008217 A 1/2018

* cited by examiner

COMPRESSOR MODULE AND COMPRESSOR MODULE DESIGNING METHOD

BACKGROUND OF THE DISCLOSURE

Technical Field

The present disclosure relates to a compressor module and a compressor module designing method.

The present application claims priority over Japanese Patent Application No. 2021-28518 filed on Feb. 25, 2021 and Japanese Patent Application No. 2021-164590 filed on Oct. 6, 2021, and the contents thereof are incorporated herein by reference.

Description of Related Art

For example, Japanese Unexamined Patent Application, First Publication No. 2013-60882 discloses a compressor module including a compressor which compresses a gas, a gas cooler which cools the gas compressed by the compressor, a drive unit which drives the compressor, and other integrated devices. There is a merit that the compressor module can be made compact as a whole with such a configuration.

SUMMARY

Incidentally, in the compressor module, it is desired to further decrease the size of the gas cooler. Even in this case, it is preferable that the gas cooling performance by the gas cooler can be ensured.

The present disclosure has been made to solve the above-described problems and an object is to provide a compressor module and a compressor module designing method capable of decreasing a size while maintaining the cooling performance of a gas cooler.

In order to solve the above-described problems, a compressor module according to the present disclosure includes: a compressor; and a high-pressure gas cooler configured to cool gas discharged from the compressor, wherein the high-pressure gas cooler includes a plurality of gas cooler split bodies, each gas cooler split body includes a high-pressure casing which is formed in a cylindrical container shape extending in a horizontal direction and to which the gas is introduced and a high-pressure heat exchange unit which is installed in the high-pressure casing and is configured to cool gas passing in one direction orthogonal to a center axis of the high-pressure casing, and the gas cooler split bodies are arranged in parallel so that the center axes of the high-pressure casings are parallel to each other, and the gas sequentially flows through the gas cooler split bodies.

According to the present disclosure, it is possible to decrease the size as a whole while maintaining the cooling performance of the gas cooler.

DETAILED DESCRIPTION OF THE DISCLOSURE

Figure 1:
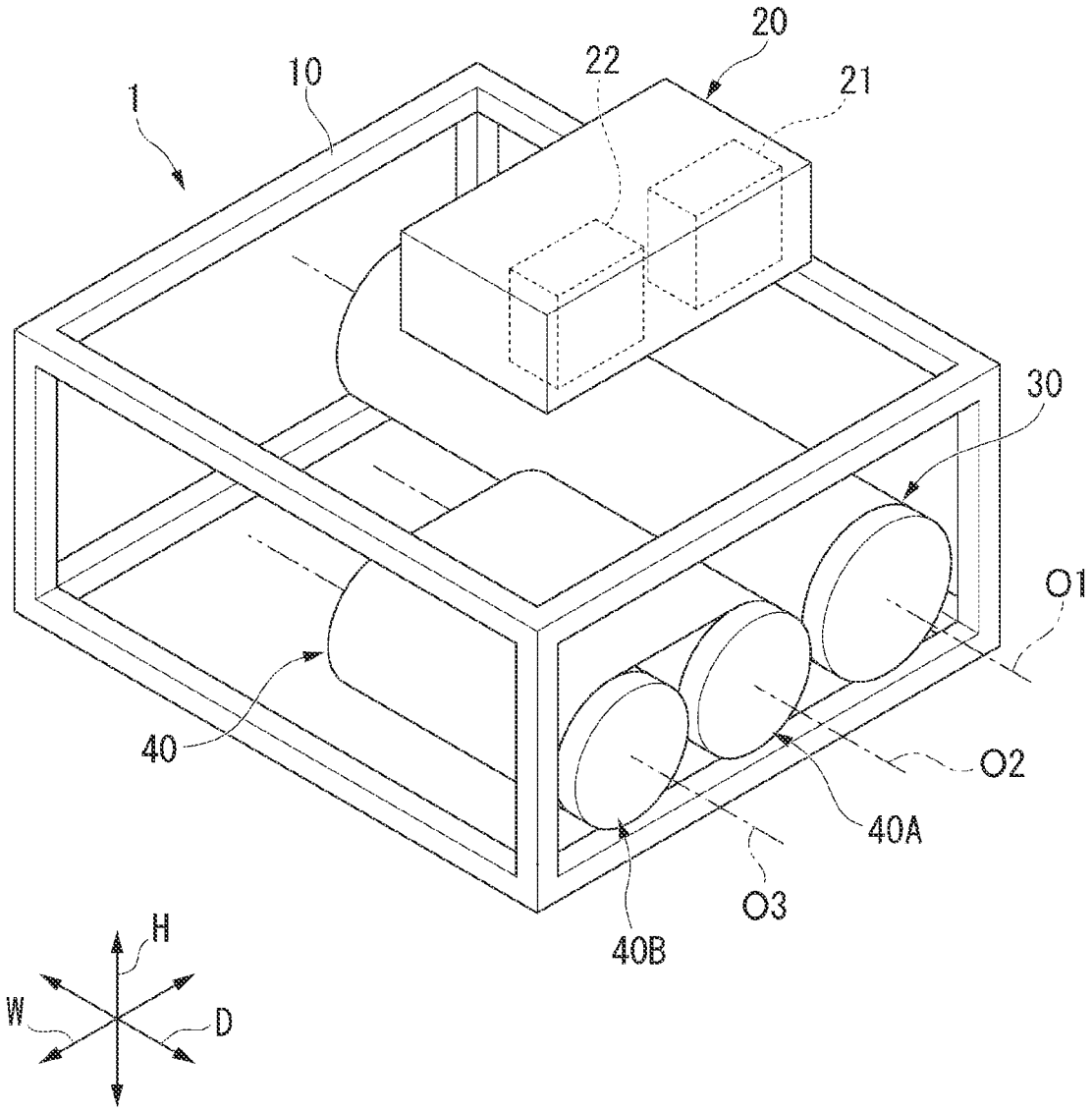
FIG. 1 is a perspective view of a compressor module according to an embodiment of the present disclosure.

Hereinafter, an embodiment of the present disclosure will be described in detail with reference to FIGS. 1 to 5. A compressor module 1 according to the embodiment includes, as shown in FIG. 1, a base 10, a compressor 20, a low-pressure gas cooler 30, and a high-pressure gas cooler 40.

<Base>

The base 10 is a member for modularizing devices which are components of the compressor module 1. The base 10 and the devices integrally mounted on the base 10 are provided as the completed compressor module 1.

The base 10 of this embodiment has a frame shape including beams and columns extending along each side of a rectangular parallelepiped. The sides of the frame extend in the vertical direction H and the longitudinal direction D and the width direction W which are two horizontal directions orthogonal to the vertical direction H. The longitudinal direction D is orthogonal to the width direction W.

<Compressor>

The compressor 20 is mounted on the upper portion of the frame-shaped base 10. The compressor 20 compresses and discharges a gas by being rotationally driven by, for example, a drive unit such as a motor or a turbine. The compressor 20 of this embodiment has a plurality of compression stages. That is, the compressor 20 has a low-pressure stage 21 which compresses a gas introduced from the outside as a first stage and a high-pressure stage 22 which further compresses the gas discharged from the low-pressure stage 21 as a second stage.

<Low-Pressure Gas Cooler>

As shown in FIG. 1, the low-pressure gas cooler 30 is installed inside the frame-shaped base 10. The low-pressure gas cooler 30 is disposed to extend in the longitudinal direction D of the compressor module 1 and to be located at a position biased to one side of the compressor module 1 in the width direction W.

The low-pressure gas cooler 30 cools a low-pressure gas discharged from the low-pressure stage 21 of the compressor 20. The low-pressure gas which is cooled by the low-pressure gas cooler 30 is supplied to the high-pressure stage 22 of the compressor 20. That is, the low-pressure gas cooler 30 is positioned between the low-pressure stage 21 and the high-pressure stage 22 in the gas flow path and is connected to the low-pressure stage 21 and the high-pressure stage 22 by a pipe (not shown).

Figure 2:
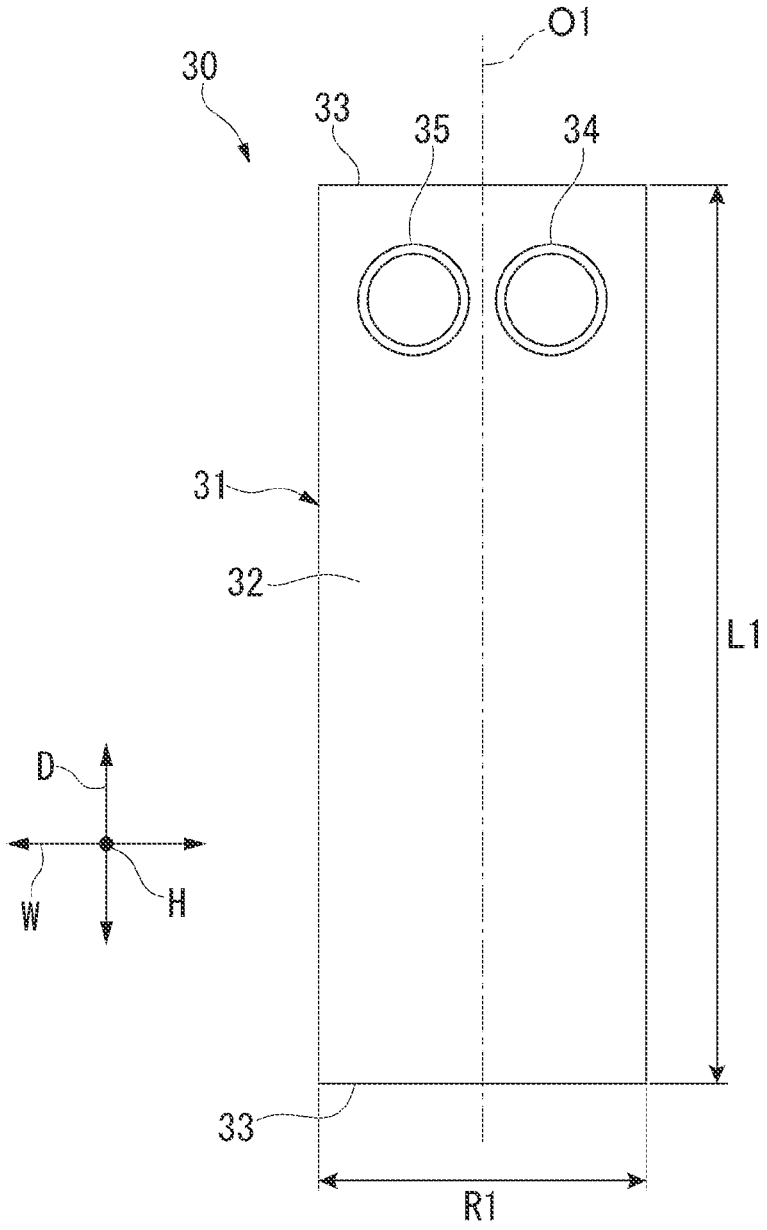
FIG. 2 is a plan view of a low-pressure gas cooler of the compressor module according to the embodiment of the present disclosure.
Figure 3:
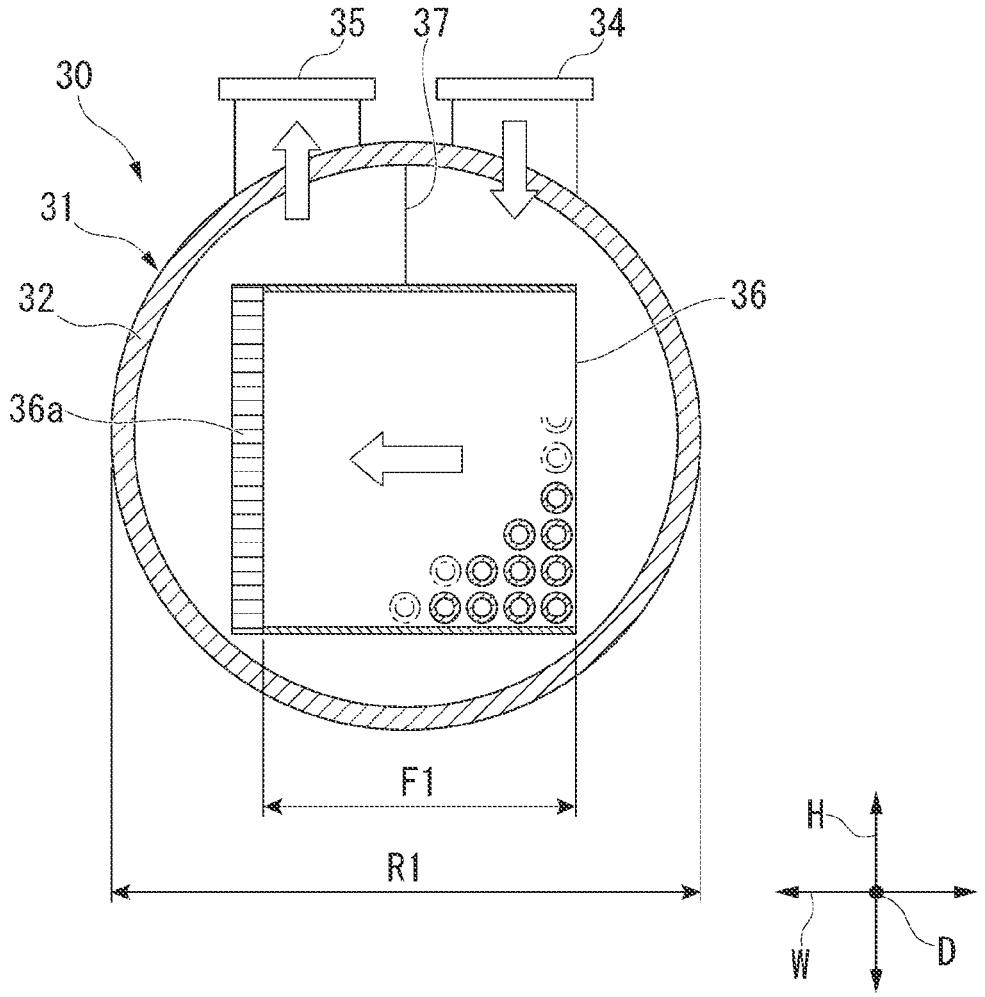
FIG. 3 is a cross-sectional view of the low-pressure gas cooler of the compressor module according to the embodiment of the present disclosure.

Specifically, as shown in FIGS. 2 and 3, the low-pressure gas cooler 30 includes a low-pressure casing 31 and a low-pressure heat exchange unit 36.

<Low-Pressure Casing>

The low-pressure casing 31 has a cylindrical container shape into which the low-pressure gas discharged by the low-pressure stage 21 of the compressor 20 is introduced. The low-pressure casing 31 includes a low-pressure cylindrical portion 32, a pair of low-pressure lid portions 33, a low-pressure gas inlet portion 34, and a low-pressure gas outlet portion 35.

The low-pressure cylindrical portion 32 is formed in a cylindrical shape having a center axis O1 extending in the longitudinal direction D. The radial thickness of the low-pressure cylindrical portion 32 is uniform. The pair of low-pressure lid portions 33 are attached to the openings on both sides of the low-pressure cylindrical portion 32 in the longitudinal direction so as to close the openings. A low-pressure gas flows in an inner space defined by the low-pressure cylindrical portion 32 and the low-pressure lid portion 33. The low-pressure cylindrical portion 32 and the low-pressure lid portion 33 are hermetically and liquid-tightly integrated so as to withstand the pressure of the low-pressure gas.

The low-pressure gas inlet portion 34 and the low-pressure gas outlet portion 35 are formed in the low-pressure cylindrical portion 32 of the low-pressure casing 31 at a position close to the other side of the longitudinal direction D in the upper portion of the low-pressure cylindrical portion 32. The low-pressure gas inlet portion 34 and the low-pressure gas outlet portion 35 communicate a space inside the low-pressure casing 31 with the outside. The low-pressure gas inlet portion 34 and the low-pressure gas outlet portion 35 are arranged in parallel in the width direction W of the compressor module 1. The low-pressure gas inlet portion 34 is formed on one side of the width direction W and the low-pressure gas outlet portion 35 is formed on the other side of the width direction W.

The low-pressure gas inlet portion 34 is connected to the discharge port of the low-pressure stage 21 of the compressor 20 by a pipe (not shown). The low-pressure gas which is discharged from the low-pressure stage 21 is introduced into the low-pressure casing 31 through the low-pressure gas inlet portion 34.

The low-pressure gas outlet portion 35 is connected to a suction port of the high-pressure stage 22 of the compressor 20 by a pipe (not shown). The low-pressure gas flowing through the low-pressure casing 31 is discharged from the low-pressure casing 31 through the low-pressure gas outlet portion 35 and then is introduced into the suction port of the high-pressure stage 22.

<Low-Pressure Heat Exchange Unit>

As shown in FIG. 3, the low-pressure heat exchange unit 36 is accommodated in a space inside the low-pressure casing 31. The low-pressure heat exchange unit 36 cools the low-pressure gas introduced into the low-pressure casing 31. The low-pressure heat exchange unit 36 includes a heat transfer tube group which includes a plurality of heat transfer tubes extending in the longitudinal direction D. Cooling water supplied from the outside flows in the heat transfer tube. The low-pressure gas introduced into the low-pressure casing 31 passes through the heat transfer tube group of the low-pressure heat exchange unit 36 to be cooled while exchanging heat with the cooling water.

The cross-sectional shape orthogonal to the center axis O1 of the low-pressure casing 31 in the low-pressure heat exchange unit 36 has a rectangular shape with the width direction W and the vertical direction H as one side.

The flow direction of the low-pressure gas passing through the low-pressure heat exchange unit 36 is one direction orthogonal to the center axis O1 of the low-pressure casing 31. In this embodiment, the low-pressure gas passes through the low-pressure heat exchange unit 36 to penetrate in the horizontal direction from one side to the other side of the width direction W. That is, the low-pressure gas flows along a pair of upper and lower sides of the low-pressure heat exchange unit 36 having a rectangular cross-section.

A length F1 of the low-pressure heat exchange unit 36 in the flow direction of the low-pressure gas is set as large as possible according to the inner diameter of the low-pressure casing 31.

A partition plate 37 for separating a space inside the low-pressure casing 31 into a low-pressure gas inlet portion side and a low-pressure gas outlet portion side is installed between the upper portion of the low-pressure heat exchange unit 36 and the top portion of the inner peripheral surface of the low-pressure casing 31. Accordingly, the entire amount of the low-pressure gas introduced from the low-pressure gas inlet portion 34 into the low-pressure casing 31 passes through the low-pressure heat exchange unit 36.

A low-pressure demister 36a is provided at the downstream end portion of the low-pressure heat exchange unit 36 in the flow direction of the low-pressure gas, that is, the end portion on the other side of the width direction W. Accordingly, moisture in the low-pressure gas is removed.

<High-Pressure Gas Cooler>

As shown in FIG. 1, the high-pressure gas cooler 40 is located inside the frame-shaped base 10 similarly to the low-pressure gas cooler. The high-pressure gas cooler 40 is located to be adjacent to the other side of the low-pressure gas cooler 30 in the width direction W.

The high-pressure gas cooler 40 cools the high-pressure gas discharged from the high-pressure stage 22 of the compressor 20. That is, the high-pressure gas cooler 40 is connected to the discharge port of the high-pressure stage 22 by a pipe (not shown). The high-pressure gas which is cooled by the high-pressure gas cooler 40 is sent to the next step.

Figure 4:
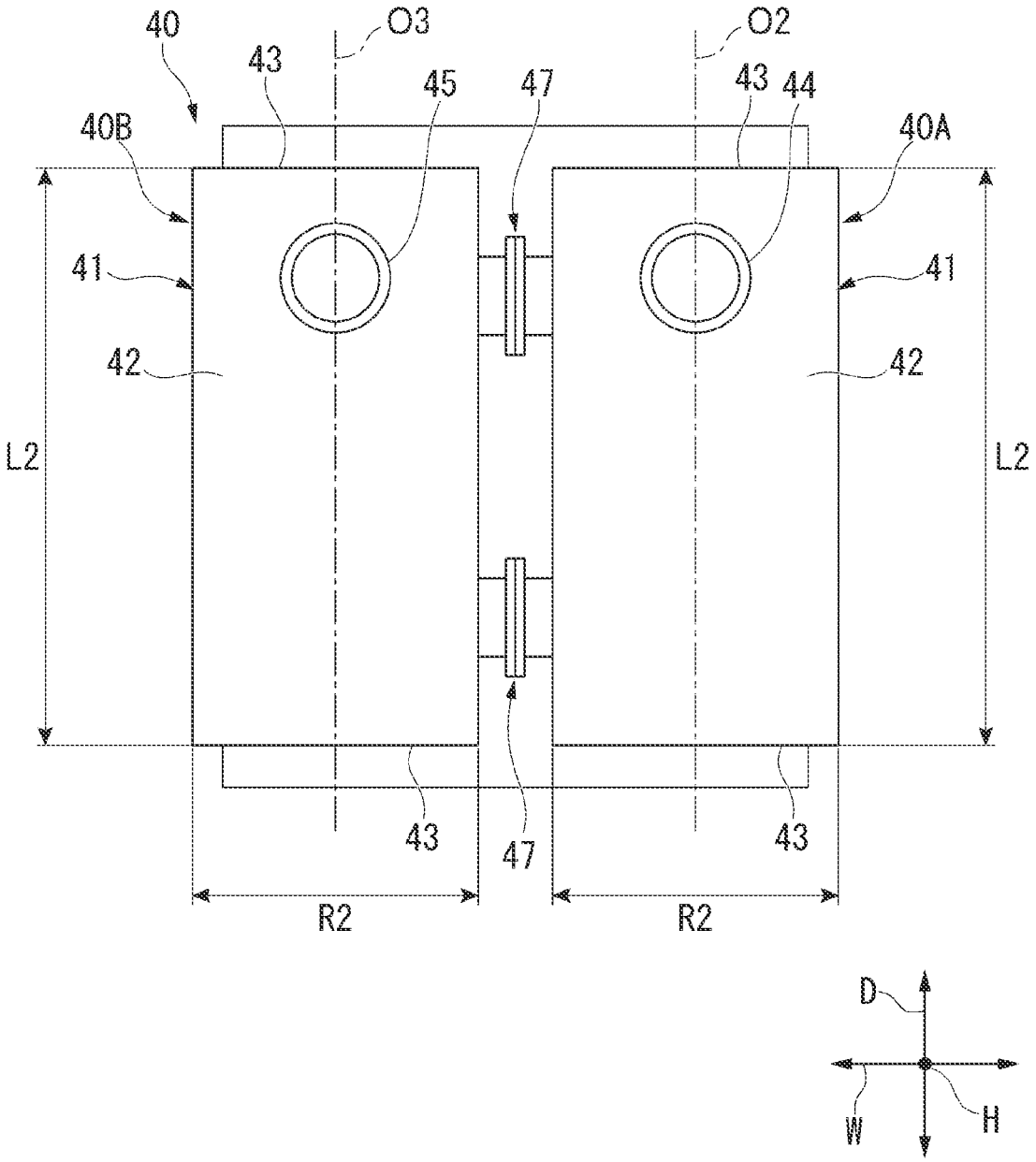
FIG. 4 is a plan view of a high-pressure gas cooler of the compressor module according to the embodiment of the present disclosure, where the description of a cover is omitted.
Figure 5:
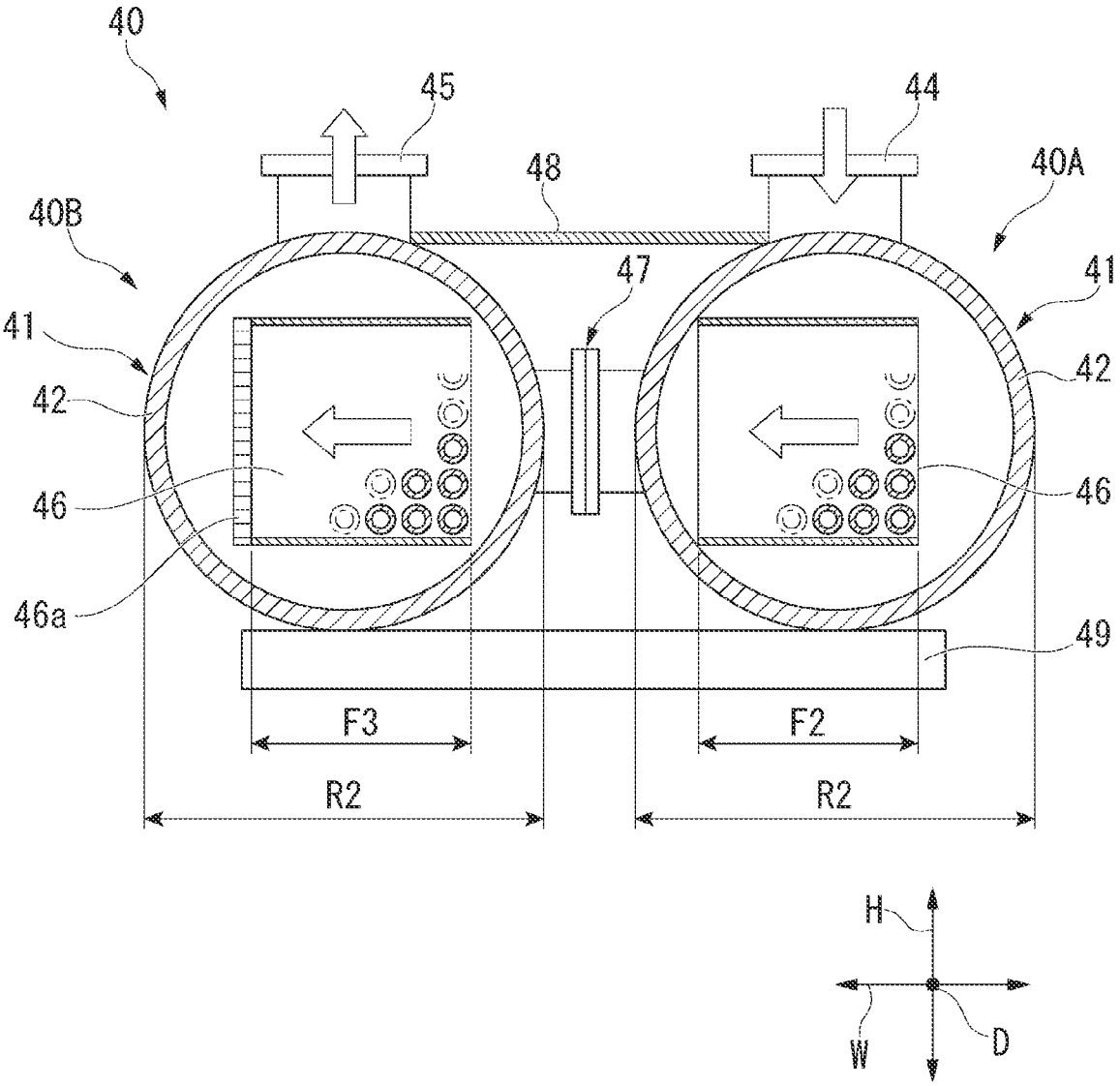
FIG. 5 is a cross-sectional view of the high-pressure gas cooler of the compressor module according to the embodiment of the present disclosure.

Specifically, as shown in FIGS. 4 and 5, the high-pressure gas cooler 40 includes a first gas cooler split body 40A and a second gas cooler split body 40B which are a pair of gas cooler split bodies and a connection portion 47.

Each of the first gas cooler split body 40A and the second gas cooler split body 40B functions as a gas cooler. Each of the first gas cooler split body 40A and the second gas cooler split body 40B includes a high-pressure casing 41 and a high-pressure heat exchange unit 46.

<High-Pressure Casing>

The high-pressure casing 41 has a cylindrical container shape into which the high-pressure gas discharged by the high-pressure stage 22 of the compressor 20 is introduced. The high-pressure casing 41 includes a high-pressure cylindrical portion 42 and a pair of high-pressure lid portions 43.

The high-pressure cylindrical portion 42 is formed in a cylindrical shape having center axes O2 and O3 extending in the longitudinal direction D. The radial thickness of the high-pressure cylindrical portion 42 is uniform and is the same as the thickness of the low-pressure cylindrical portion 32. The pair of high-pressure lid portions 43 are attached to the openings on both sides of the high-pressure cylindrical portion 42 in the longitudinal direction so as to close the openings. A high-pressure gas flows through an inner space defined by the high-pressure cylindrical portion 42 and the high-pressure lid portion 43. The high-pressure cylindrical portion 42 and the high-pressure lid portion 43 are hermetically and liquid-tightly integrated so as to withstand the pressure of the high-pressure gas.

The high-pressure casing 41 of the first gas cooler split body 40A and the high-pressure casing 41 of the second gas cooler split body 40B are arranged in parallel in the width direction W of the compressor module 1 while the center axes O2 and O3 are parallel to each other. That is, the parallel arrangement direction of the first gas cooler split body 40A and the second gas cooler split body 40B matches the width direction W.

A high-pressure gas inlet portion 44 is formed at the upper portion of the high-pressure casing 41 of the first gas cooler split body 40A and a portion close to the other side of the longitudinal direction D. The high-pressure gas inlet portion 44 communicates a space inside the high-pressure casing 41 of the first gas cooler split body 40A with the outside. The high-pressure gas inlet portion 44 is connected to the discharge port of the high-pressure stage 22 of the compressor 20 through a pipe (not shown). The high-pressure gas discharged from the high-pressure stage 22 of the compressor 20 is introduced into the high-pressure casing 41 of the first gas cooler split body 40A through the high-pressure gas inlet portion 44.

A high-pressure gas outlet portion 45 is formed at the upper portion of the high-pressure casing 41 of the second gas cooler split body 40B and a portion close to the other side of the longitudinal direction D. The high-pressure gas outlet portion 45 communicates a space inside the high-pressure casing 41 of the second gas cooler split body 40B with the outside. The high-pressure gas in the high-pressure casing 41 of the second gas cooler split body 40B is discharged to the outside through the high-pressure gas outlet portion 45.

<High-Pressure Heat Exchange Unit>

As shown in FIG. 5, the high-pressure heat exchange unit 46 is accommodated in a space inside the high-pressure casing 41 of each of the first gas cooler split body 40A and the second gas cooler split body 40B. The high-pressure heat exchange unit 46 cools the high-pressure gas introduced into the high-pressure casing 41. The high-pressure heat exchange unit 46 includes a heat transfer tube group which includes a plurality of heat transfer tubes extending in the longitudinal direction D. Cooling water supplied from the outside flows in each of the heat transfer tubes constituting the heat transfer tube group. The high-pressure gas introduced into the high-pressure casing 41 passes through the heat transfer tube group of the high-pressure heat exchange unit 46 to be cooled while exchanging heat with the cooling water.

The cross-sectional shape orthogonal to the center axes O2 and O3 of the high-pressure casing 41 in the high-pressure heat exchange unit 46 has a rectangular shape with the width direction W and the vertical direction H as one side.

The flow direction of the high-pressure gas passing through the high-pressure heat exchange unit 46 is one direction orthogonal to the center axes O2 and O3 of the high-pressure casing 41. In this embodiment, the high-pressure gas passes through the high-pressure heat exchange unit 46 to penetrate in the horizontal direction from one side toward the other side of the width direction W. That is, the high-pressure gas flows along a pair of upper and lower sides of the high-pressure heat exchange unit 46 having a rectangular cross-section.

The lengths F2 and F3 of the high-pressure heat exchange unit 46 in the flow direction of the high-pressure gas are set as large as possible in accordance with the inner diameter of the high-pressure casing 41.

The first gas cooler split body 40A and the second gas cooler split body 40B are connected to each other by the connection portion 47. A pair of the connection portions 47 are separated from each other in the longitudinal direction D. The connection portion 47 has a straight tubular shape that connects the high-pressure casing 41 of the first gas cooler split body 40A and the high-pressure casing 41 of the second gas cooler split body 40B in the width direction W. The connection portion 47 communicates the inside of the high-pressure casing 41 of the first gas cooler split body 40A with the inside of the high-pressure casing 41 of the second gas cooler split body 40B in the width direction W. Accordingly, the entire amount of the high-pressure gas passing through the high-pressure heat exchange unit 46 of the first gas cooler split body 40A directly passes through the high-pressure heat exchange unit 46 of the second gas cooler split body 40B through the connection portion 47.

A high-pressure demister 46a is provided at the downstream end portion of the high-pressure heat exchange unit 46 of the second gas cooler split body 40B in the flow direction of the high-pressure gas, that is, the end portion on the other side of the width direction W. Accordingly, moisture in the high-pressure gas is removed.

A cover 48 is installed at the upper portions of the first gas cooler split body 40A and the second gas cooler split body 40B to straddle the upper ends of the high-pressure casings 41 and extend in the longitudinal direction D.

Further, the first gas cooler split body 40A and the second gas cooler split body 40B are installed on the same base plate 49.

In this way, the first gas cooler split body 40A and the second gas cooler split body 40B are integrated with each other through the connection portion 47, the cover 48, and the base plate 49 to configure one high-pressure gas cooler 40.

<Dimensions of Low-Pressure Gas Cooler and High-Pressure Gas Cooler>

Here, the length L2 of the high-pressure casing 41 in the direction of the center axes O2 and O3 (the longitudinal direction D) shown in FIG. 4 is set to be equal to or shorter than the length L1 of the low-pressure casing 31 in the direction of the center axis O1 (the longitudinal direction D) shown in FIG. 2 and is preferably set to be shorter than the length L1. That is, the length L2 of the high-pressure casing 41 is set to ¼ to ¾ of the length L1 of the low-pressure casing, preferably ⅓ to ⅔, and more preferably about ½.

Further, the diameter R2 of the high-pressure casing 41 shown in FIG. 5 is set to be equal to or smaller than the diameter R1 of the low-pressure casing 31 shown in FIG. 3 and preferably smaller than the diameter R1.

Further, the lengths F2 and F3 of the high-pressure heat exchange units 46 in the flow direction of the high-pressure gas shown in FIG. 5 are set to be shorter than the length F1 of the low-pressure heat exchange unit 36 in the flow direction of the low-pressure gas shown in FIG. 3. On the other hand, the total dimension (F2+F3) of the high-pressure heat exchange unit 46 of the high-pressure gas cooler 40 in the flow direction of the high-pressure gas is set to be equal to or longer than the length F1 of the low-pressure heat exchange unit 36 in the flow direction of the low-pressure gas.

<Operation and Effect>

In the compressor module 1 with the above-described configuration, a gas introduced into the compressor 20 from the outside is compressed by the low-pressure stage 21 and is discharged as a low-pressure gas and the low-pressure gas is introduced into the low-pressure gas cooler 30 to be cooled. That is, the low-pressure gas introduced into the low-pressure casing 31 of the low-pressure gas cooler 30 passes through the low-pressure heat exchange unit 36 from one side to the other side of the width direction W and is cooled to an appropriate temperature by heat exchange in this process. The cooled low-pressure gas is discharged from the low-pressure casing 31 and then is compressed by the high-pressure stage 22 of the compressor 20 to be a high-pressure gas. The high-pressure gas discharged from the high-pressure stage 22 is sequentially introduced into the first gas cooler split body 40A and the second gas cooler split body 40B of the high-pressure gas cooler 40 to be cooled.

That is, the high-pressure gas introduced into the first gas cooler split body 40A of the high-pressure gas cooler 40 passes through the high-pressure heat exchange unit 46 in the high-pressure casing 41 of the first gas cooler split body 40A in one direction from one side to the other side of the width direction W and is cooled by heat exchange at a first stage in this process. Next, the high-pressure gas directly flows through the connection portion 47 in one direction to be introduced into the high-pressure casing 41 of the second gas cooler split body 40B. Then, the high-pressure gas passes through the high-pressure heat exchange unit 46 in the high-pressure casing 41 in one direction from one side to the other side of the width direction W and is cooled to an appropriate temperature by heat exchange at a second stage in this process. Then, the high-pressure gas cooled in this way is sent to the next process.

As described above, according to this embodiment, the high-pressure gas cooler 40 is divided into the first gas cooler split body 40A and the second gas cooler split body 40B. Therefore, for example, as compared with the case of the low-pressure gas cooler 30 including only one low-pressure casing 31, the diameter of each high-pressure casing 41 can be decreased. Then, it is possible to decrease the dimension of the high-pressure gas cooler 40 in the vertical direction H as a whole by providing such high-pressure casings 41 in parallel in the horizontal direction.

Accordingly, it is possible to form a new space in the compressor module 1 and to improve the degree of freedom in installing each device. Further, it is possible to make the compressor module 1 compact as a whole. Furthermore, it is possible to decrease the manufacturing cost due to the compact size. As the diameter of the high-pressure casing 41 decreases, it is possible to improve the maintainability of the high-pressure casing 41.

Here, the cooling performance of the gas cooler is improved as the length of the heat exchange unit in the gas flow direction increases. That is, since the heat exchange region between the gas and the cooling water increases when the dimension of the heat exchange unit in the gas flow direction is long, it is possible to more effectively cool the gas. In this embodiment, it is possible to largely ensure the total length (F2+F3) of the high-pressure heat exchange units 46 in the gas flow direction while dividing the high-pressure gas cooler 40 into the first gas cooler split body 40A and the second gas cooler split body 40B. Therefore, the cooling performance can be maintained.

Further, the high-pressure gas flows through the high-pressure heat exchange units 46 of the first gas cooler split body 40A and the second gas cooler split body 40B, arranged in parallel in the width direction W, in the same direction. Then, the high-pressure gas also flows through the connection portion 47 between the first gas cooler split body 40A and the second gas cooler split body 40B in the same direction. Therefore, the connecting portion 47 can be easily handled, and the high-pressure gas cooler 40 can be made compact as a whole. Further, since the flow direction of the high-pressure gas in the high-pressure gas cooler 40 does not change carelessly, the pressure loss can be reduced.

Further, in this embodiment, the low-pressure gas discharged from the low-pressure stage 21 of the compressor 20 is cooled by the low-pressure gas cooler 30 including one low-pressure casing 31 instead of a plurality of divided low-pressure casings. On the other hand, the gas discharged from the high-pressure stage 22 of the compressor 20 is cooled by the high-pressure gas cooler 40 divided into the first gas cooler split body 40A and the second gas cooler split body 40B. Accordingly, it is possible to make the compressor module 1 compact as a whole while balancing the volumetric flow rate of the gas and the size of the gas cooler.

Here, since the volumetric flow rate of the gas discharged from the low-pressure stage 21 is large, it is necessary to lengthen the length of the low-pressure casing 31 in the direction of the center axis O1 to ensure the cross-sectional area of the flow path of the low-pressure gas. On the other hand, since the volumetric flow rate of the high-pressure gas discharged from the high-pressure stage 22 is small, it is not necessary to ensure the cross-sectional area of the flow path of the high-pressure gas as much as the low-pressure casing 31. Therefore, it is possible to shorten the length of the high-pressure casing 41 in the direction of the center axes O2 and O3 in accordance with the volumetric flow rate of the high-pressure gas. Accordingly, it is possible to make the compressor module 1 compact as a whole while sufficiently cooling the low-pressure gas by the low-pressure gas cooler 30 and cooling the high-pressure gas by the high-pressure gas cooler 40. Particularly, in this embodiment, since a large space can be obtained behind the high-pressure gas cooler 40, it is possible to improve the degree of freedom in layout.

Other Embodiments

Although the embodiment of the present disclosure has been described above, the inventive concept included in the present disclosure is not limited thereto and can be appropriately modified without departing from the contents of the disclosure. For example, in the embodiment, an example in which the high-pressure gas cooler 40 includes two gas cooler split bodies corresponding to the first gas cooler split body 40A and the second gas cooler split body 40B has been described, but the present disclosure is not limited thereto. The high-pressure gas cooler 40 may include three or more gas cooler split bodies.

Further, the gas flow direction of the high-pressure gas passing through the high-pressure heat exchange units 46 of the first gas cooler split body 40A and the second gas cooler split body 40B does not necessarily have to be the same and may be configured so that the high-pressure gas flows in different directions. The same applies to the configuration of three or more gas cooler split bodies.

Further, the first gas cooler split body 40A and the second gas cooler split body 40B may not be arranged in parallel in the horizontal direction or may be arranged in parallel in the vertical direction H or the vertical diagonal direction. The same applies to the configuration of three or more gas cooler split bodies.

Hereinafter, a modified example and a compressor module designing method in the case in which the first gas cooler split body and the second gas cooler split body are arranged in parallel in the vertical direction H will be described with reference to the drawings. Additionally, since the compressor module of the modified example is different from the compressor module of the above-described embodiment only in the configuration of the high-pressure gas cooler, the same parts as those in the embodiment are designated by the same reference numerals and duplicate description will be omitted.

Figure 6:
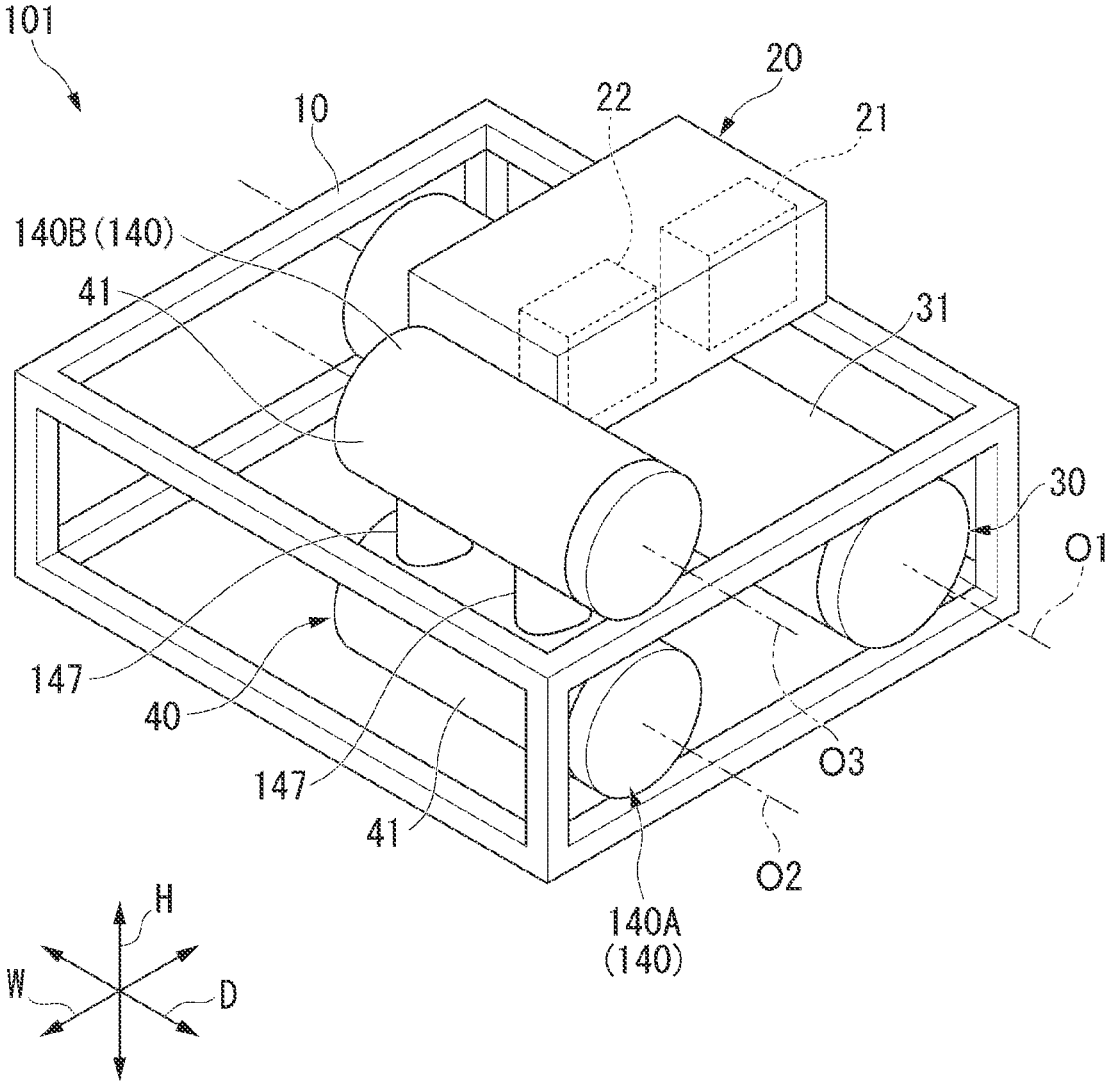
FIG. 6 is a perspective view of a compressor module according to a modified example of the embodiment of the present disclosure.

As shown in FIG. 6, a compressor module 101 of the modified example of the embodiment of the present disclosure includes the base 10, the compressor 20, the low-pressure gas cooler 30, and a high-pressure gas cooler 140.

Similarly to the above-described embodiment, the base 10 has a frame shape including beams and columns extending along each side of a rectangular parallelepiped. In other words, the base 10 of the modified example forms a rectangular parallelepiped frame.

The compressor 20 has the same configuration as that of the compressor 20 of the above-described embodiment and includes the low-pressure stage 21 and the high-pressure stage 22 as a plurality of compression stages. The low-pressure stage 21 compresses a gas introduced from the outside of the compressor 20 and the high-pressure stage 22 compresses the gas introduced from the low-pressure gas cooler 30.

The compressor 20 is mounted on the upper portion of the base 10. In other words, the base 10 is disposed below the compressor 20 and the base 10 supports the compressor 20 from below. Then, the compressor 20 is disposed at a position biased to one side of the width direction W in the upper portion of the base 10. Further, the compressor 20 of the modified example is disposed in the frame of the base 10 in a plan view. Additionally, the arrangement of the compressor 20 in the longitudinal direction D is not limited to the arrangement shown in FIG. 6.

The low-pressure gas cooler 30 cools a low-pressure gas discharged from the low-pressure stage 21 of the compressor 20. The low-pressure gas which is cooled by the low-pressure gas cooler 30 is introduced into the high-pressure stage 22 of the compressor 20. The low-pressure gas cooler 30 of the modified example also has the same configuration as the low-pressure gas cooler 30 of the above-described embodiment and is installed inside the base 10. Specifically, the low-pressure gas cooler 30 is fixed to the base 10 while being installed on the inside of the frame of the base 10. The low-pressure gas cooler 30 is disposed at a position biased to one side of the width direction W inside the base 10 and extends in the longitudinal direction D. Accordingly, the low-pressure gas cooler 30 is disposed vertically below the compressor 20. The low-pressure gas cooler 30 includes the low-pressure casing 31 and the low-pressure heat exchange unit 36 (see FIG. 3).

The high-pressure gas cooler 140 cools a high-pressure gas discharged from the high-pressure stage 22 of the compressor 20. The high-pressure gas cooler 140 is installed at a position within the frame of the base 10 in a plan view. The high-pressure gas cooler 140 includes a first gas cooler split body 140A, a second gas cooler split body 140B, and a connection portion 147. The first gas cooler split body 140A is different from the first gas cooler split body 40A of the first embodiment only in the circumferential direction centered on the center axis O2. The second gas cooler split body 140B is different from the second gas cooler split body 40B of the first embodiment only in the installation position and the circumferential direction centered on the center axis O3. Each of the first gas cooler split body 140A and the second gas cooler split body 140B includes the high-pressure casing 41 and the high-pressure heat exchange unit 46 (see FIG. 5).

The high-pressure casing 41 of the first gas cooler split body 140A and the high-pressure casing 41 of the second gas cooler split body 140B are arranged in parallel in the vertical direction H. More specifically, the center axis O2 of the first gas cooler split body 140A and the center axis O3 of the second gas cooler split body 140B extend in parallel in the longitudinal direction D. Then, the positions of the high-pressure casing 41 of the first gas cooler split body 140A and the high-pressure casing 41 of the second gas cooler split body 140B in the width direction W shown in the modified example are the same positions. In other words, the center axis O3 is located vertically above the center axis O2. Additionally, the position of the center axis O3 is not limited to the vertically upper side of the center axis O2 and may be, for example, a position deviated in the width direction W.

The high-pressure gas inlet portion 44 (see FIG. 5) of the first gas cooler split body 140A of the modified example is opened toward, for example, one side of the width direction W (upper right side in FIG. 6) so that the pipe connected to the high-pressure gas inlet portion 44 does not interfere with the second gas cooler split body 140B. Further, the high-pressure gas outlet portion 45 of the second gas cooler split body 140B of the modified example is opened toward, for example, one side of the width direction W similarly to the high-pressure gas inlet portion 44 so that the dimension of the entire compressor module 101 in the vertical direction H does not increase.

A pair of the connection portions 147 are provided between the high-pressure casings 41 to be separated from each other in the longitudinal direction D. The connection portion 147 connects the high-pressure casing 41 of the first gas cooler split body 140A and the high-pressure casing 41 of the second gas cooler split body 140B in the vertical direction H. The connection portion 147 communicates an inner space of the high-pressure casing 41 of the first gas cooler split body 140A with an inner space of the high-pressure casing 41 of the second gas cooler split body 140B.

Accordingly, similarly to the above-described embodiment, the high-pressure gas passing through the high-pressure heat exchange unit 46 of the first gas cooler split body 140A passes through the high-pressure heat exchange unit 46 of the second gas cooler split body 140B through the connection portion 147. The flow direction of the high-pressure gas passing through the high-pressure heat exchange unit 46 of the modified example is set to one direction orthogonal to the center axes O2 and O3 of the high-pressure casing 41. In the modified example, the high-pressure gas passes to penetrate from one side (the lower side) to the other side (the upper side) of the vertical direction H.

Similarly to the above-described embodiment, the length of the first gas cooler split body 140A in the direction of the center axis O2 of the modified example is the length L2 (see FIG. 4) which is the same as the length of the second gas cooler split body 140B in the direction of the center axis O3. Here, the length L2 may be equal to or shorter than the length L1 of the low-pressure gas cooler 30 in the direction of the center axis O1. Further, the length L2 may be shorter than the length L1 and, for example, the length L2 may be the length of ¼ to ¾ of the length L1. Further, the length L2 can be set to the length of ⅓ to ⅔ of the length L1. Additionally, the length L2 of the modified example is set to about ½ of the length L1.

Further, similarly to the above-described embodiment, in the modified example, the diameter R2 (see FIG. 4) of the high-pressure casing 41 of the high-pressure gas cooler 140 is smaller than the diameter R1 (see FIG. 2) of the low-pressure casing 31 of the low-pressure gas cooler 30. Further, the lengths F2 and F3 (see FIG. 5) of the high-pressure heat exchange units 46 of the high-pressure gas cooler 140 in the flow direction of the high-pressure gas are smaller than the length Fl (see FIG. 3) of the low-pressure heat exchange unit 36 of the low-pressure gas cooler 30 in the flow direction of the low-pressure gas. Then, the total dimension (F2+F3) of the high-pressure heat exchange units 46 of the high-pressure gas cooler 140 in the flow direction of the high-pressure gas is set to be equal to or longer than the length Fl of the low-pressure heat exchange unit 36 in the flow direction of the low-pressure gas.

Figure 7:
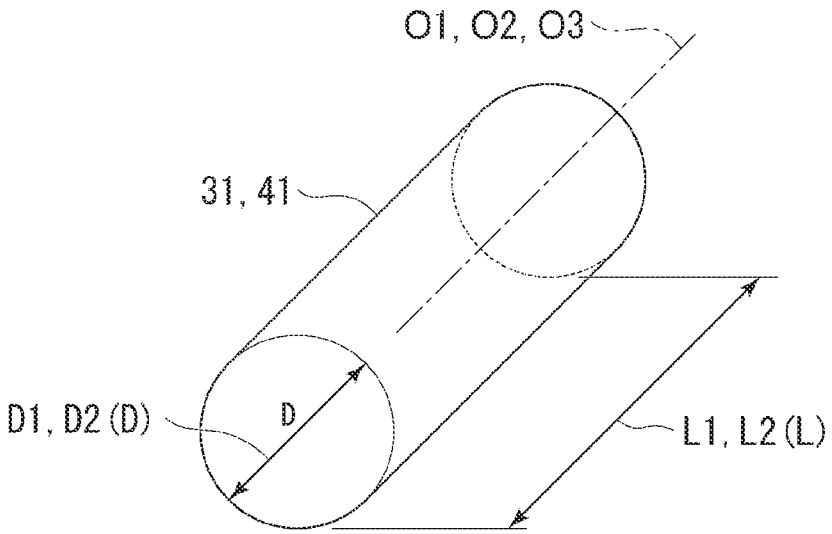
FIG. 7 is a diagram showing D/L of a casing according to a modified example of the embodiment of the present disclosure.
Figure 8:
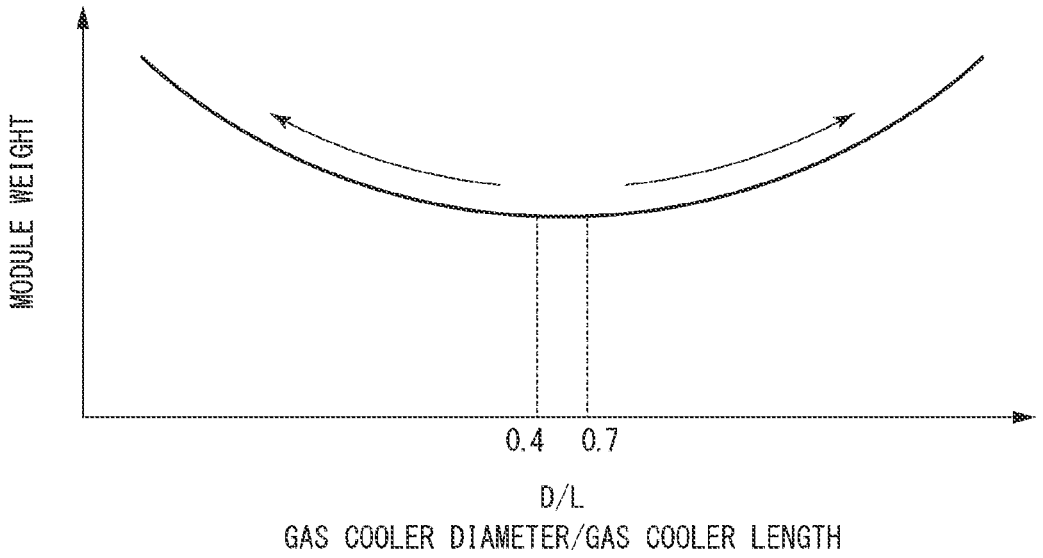
FIG. 8 is a graph in which a vertical axis is a weight of a compressor module and a horizontal axis is D/L.

FIG. 7 is a diagram showing the D/L of the casing of the modified example of the embodiment of the present disclosure. FIG. 8 is a graph in which the vertical axis is the weight of the compressor module and the horizontal axis is the D/L.

As shown in FIG. 7, for example, the diameter of the high-pressure casing (casing) 41 having a cylindrical container shape is D1 and the length of the high-pressure casing 41 is L1. Similarly, the diameter of the cylindrical low-pressure casing (casing) 31 is D2 and the length of the low-pressure casing 31 is L2.

The values of the D1/L1 which are the D/L of the high-pressure casing 41 of the first gas cooler split body 140A and the high-pressure casing 41 of the second gas cooler split body 140B of the modified example are in the range of 0.4 to 0.7. Further, the D2/L2 which is the D/L of the low-pressure casing 31 of the low-pressure gas cooler 30 is in the range of 0.4 to 0.7.

As shown in FIG. 8, as the D/L of the gas cooler including the casing having a cylindrical container shape becomes larger than the range of 0.4 to 0.7, the entire weight of the compressor module 101 increases and the increase rate thereof gradually increases (see the arrow on the right in FIG. 8). Here, the fact that the D/L increases while ensuring the same volume means that the diameter of the gas cooler increases. In this case, the dimension of the width direction W and the dimension of the vertical direction H of the entire base 10 increase. Therefore, since it is necessary to use a highly rigid member for the base 10 due to the possibility that the base 10 supporting the compressor 20 from below may be deformed, the weight of the base 10 increases.

Similarly, as the D/L of the gas cooler including the casing having a cylindrical container shape becomes smaller than the range of 0.4 to 0.7, the entire weight of the compressor module 101 increases and the increase rate thereof gradually increases (see the arrow on the left in FIG. 8). This means that the length of the gas cooler increases contrary to the case where the D/L increases. In this case, the length of the heat transfer tube of the heat exchange unit (the low-pressure heat exchange unit 36, the high-pressure heat exchange unit 46) increases and the weight of the gas cooler increases.

That is, it is possible to suppress an increase in the weight of the compressor module 101 by setting the D/L of the gas cooler to the range of 0.4 to 0.7. Additionally, FIG. 8 shows a case in which the D/L at which the weight of the compressor module 101 is the lowest is the median value of the range of 0.4 to 0.7, but the D/L at which the weight of the compressor module 101 is the lowest is not limited to the median value of the range of 0.4 to 0.7.

<Operation and Effect of Modified Example>

In the compressor module 101 of the modified example, the first gas cooler split body 140A and the second gas cooler split body 140B are arranged in parallel so that the center axes O2 and O3 of the high-pressure casings 41 are parallel to each other and the second gas cooler split body 140B is disposed above the first gas cooler split body 140A. Then, the gas discharged from the high-pressure stage 22 sequentially flows through the first gas cooler split body 140A and the second gas cooler split body 140B.

With such a configuration, it is possible to decrease the dimension of the compressor module 101 in the width direction W by the diameter R2 of the second gas cooler split body 140B in addition to the operation and effect of the compressor module 101 of the above-described embodiment. Further, since the second gas cooler split body 140B having the diameter R2 smaller than the diameter R1 of the low-pressure gas cooler 30 is mounted on the upper portion of the base 10, it is possible to suppress an increase in the dimension of the compressor module 101 in the vertical direction H.

According to the method of designing the compressor module 101, since the D/L of the low-pressure gas cooler 30 and the high-pressure gas cooler 140 is in the range of 0.4 to 0.7, it is possible to suppress an increase in the total weight of the base 10, the low-pressure gas cooler 30, and the high-pressure gas cooler 140. As a result, it is possible to suppress the weight of the compressor module 101.

Additionally, in the modified example of the above-described embodiment, a case in which the D/L (that is, D1/L1, D2/L2) of both the low-pressure gas cooler 30 and the high-pressure gas cooler 140 is in the range of 0.4 to 0.7 has been described, but the D/L of only one of them may be in a range of 0.4 to 0.7.

<Appendix>

The rotary machine described in each embodiment is understood, for example, as follows.

(1) A first aspect is a compressor module including: the compressor 20; and the high-pressure gas cooler 40 configured to cool gas discharged from the compressor 20, the high-pressure gas cooler 40 includes the plurality of gas cooler split bodies 40A and 40B, each of the gas cooler split bodies 40A and 40B includes the high-pressure casing 41 which is formed in a cylindrical container shape extending in the horizontal direction so that the gas is introduced and the high-pressure heat exchange unit 46 which is installed in the high-pressure casing 41 and is configured to cool gas passing in one direction orthogonal to the center axes O2 and O3 of the high-pressure casing 41, the gas cooler split bodies 40A and 40B are installed in parallel so that the center axes O2 and 03 of the high-pressure casing 41 are parallel to each other, and the gas sequentially flows though the gas cooler split bodies 40A and 40B.

In the above-described configuration, the high-pressure gas cooler 40 is divided into the plurality of gas cooler split bodies including the high-pressure casing 41 having a cylindrical container shape. Therefore, as compared with the case in which the casing of the high-pressure gas cooler 40 is one cylindrical container, the diameter of the cylindrical container can be decreased by the amount that the casing is divided into a plurality of parts. Further, the cooling performance of the gas cooler is improved as the length of the heat exchange unit in the gas flow direction increases. Therefore, since the total dimension of the high-pressure heat exchange units 46 in the gas flow direction can be largely ensured even when the high-pressure gas cooler is divided into the plurality of gas cooler split bodies 40A and 40B, the cooling performance can be maintained.

(2) In a second aspect according to the compressor module 1 of the first aspect, the high-pressure heat exchange unit 46 of each of the gas cooler split bodies 40A and 40B may be configured so that the gas passes from one side to the other side of the parallel arrangement direction. The high-pressure gas cooler 40 may further include the connection portion 47 which is installed between the adjacent gas cooler split bodies so that the gas flows from the gas cooler split body 40A on one side of the parallel arrangement direction to the gas cooler split body 40B on the other side of the parallel arrangement direction.

Since the gas compressed by the compressor 20 is sequentially introduced from the other side to one side of the parallel arrangement direction with respect to the plurality of gas cooler split bodies 40A and 40B arranged in parallel, the connection portion 47 can be easily handled and the overall size can be decreased. Further, since the gas flow direction does not change carelessly, the pressure loss can be reduced.

(3) In a third aspect according to the compressor module 1 of the first or second aspect, the compressor 20 may include the low-pressure stage 21 which is configured to compress gas introduced from the outside and the high-pressure stage 22 which is configured to further compress the gas compressed by the low-pressure stage 21. The high-pressure gas cooler 40 may cool the gas discharged from the high-pressure stage 22. The compressor module may further include the low-pressure gas cooler 30 which is configured to cool the gas discharged from the low-pressure stage 21 and then introduced into the high-pressure stage 22. The low-pressure gas cooler 30 may include the low-pressure casing 31 which is formed in a cylindrical container shape extending in the horizontal direction so that the gas is introduced and the low-pressure heat exchange unit 36 which is installed in the low-pressure casing 31 and is configured to cool the gas passing in one direction orthogonal to the center axis O1 of the low-pressure casing 31.

In the above-described configuration, the low-pressure gas discharged from the low-pressure stage 21 of the compressor 20 is cooled by the low-pressure gas cooler 30 which is not divided into a plurality of parts and the gas discharged from the high-pressure stage 22 of the compressor 20 is cooled by the high-pressure gas cooler 40 which is divided into the plurality of gas cooler split bodies 40A and 40B. Accordingly, it is possible to make the compressor module 1 compact as a whole while balancing the volumetric flow rate of the gas and the size of the gas cooler.

(4) In a fourth aspect according to the compressor module 1 of the third aspect, the length L2 of the high-pressure casing 41 in the direction of the center axes O2 and O3 may be equal to or shorter than the length L1 of the low-pressure casing 31 in the direction of the center axis O1.

Since the gas discharged from the low-pressure stage 21 has a large volumetric flow rate, it is necessary to lengthen the length of the low-pressure casing 31 in the direction of the center axis O1 to ensure the cross-sectional area of the flow path. Since the gas discharged from the high-pressure stage 22 has a small volumetric flow rate, the cross-sectional area of the flow path is not as necessary as the low-pressure casing 31. Therefore, it is possible to shorten the length L2 of the high-pressure casing 41 in the direction of the center axes O2 and O3. Accordingly, it is possible to make the compressor module 1 compact as a whole while sufficiently cooling the compressed gas by the gas cooler.

(5) In a fifth aspect according to the compressor module 1 of the third or fourth aspect, the diameter of the high-pressure casing 41 may be equal to or smaller than the diameter of the low-pressure casing 31.

Accordingly, it is possible to ensure the required cooling performance while suppressing the size of the high-pressure gas cooler 40.

(6) In a sixth aspect according to the compressor module of any one of the first to fifth aspects, the plurality of gas cooler split bodies 140A and 140B may be arranged in the vertical direction H.

Accordingly, it is possible to decrease the dimension of the compressor module 101 in the width direction W by the diameter R2 of the second gas cooler split body 140B. Further, since the second gas cooler split body 140B having the diameter R2 smaller than the diameter R1 of the low-pressure gas cooler 30 is mounted on the upper portion of the base 10, it is possible to suppress an increase in the dimension of the compressor module 101 in the vertical direction H.

(7) In a seventh aspect according to the compressor module of any one of the first to sixth aspects, when the diameter of the high-pressure casing 41 is D1 and the length of the high-pressure casing is L1, the value of D1/L1 may be in the range of 0.4 to 0.7.

Accordingly, it is possible to suppress an increase in the total weight of the base 10 and the high-pressure gas cooler 140. As a result, it is possible to suppress the weight of the compressor module 101.

(8) In an eighth aspect according to the compressor module of the third aspect, when the diameter of the low-pressure casing is D2 and the length of the low-pressure casing 31 is L2, the value of D2/L2 may be in the range of 0.4 to 0.7.

It is possible to suppress an increase in the total weight of the base 10 and the low-pressure gas cooler 30. As a result, it is possible to suppress the weight of the compressor module 101.

(9) A ninth aspect is a compressor module designing method includes: assuming that the diameter of each of the gas coolers 30 and 140 each including a casing having a cylindrical container shape is D and the length of each of the gas coolers 30 and 140 is L; and setting a value of D/L in the range of 0.4 to 0.7.

It is possible to suppress an increase in the total weight of the base 10 and the gas coolers 30 and 140. As a result, it is possible to suppress the weight of the compressor module 101.

Examples of the gas cooler include the low-pressure gas cooler 30 and the high-pressure gas cooler 140.

EXPLANATION OF REFERENCES

1, 101 Compressor module
10 Base
20 Compressor
21 Low-pressure stage
22 High-pressure stage
30 Low-pressure gas cooler
31 Low-pressure casing
32 Low-pressure cylindrical portion
33 Low-pressure lid portion
34 Low-pressure gas inlet portion
35 Low-pressure gas outlet portion
36 Low-pressure heat exchange unit
36*a* Low-pressure demister
37 Partition plate

40 High-pressure gas cooler
40A, 140A First gas cooler split body
40B, 140B Second gas cooler split body
41 High-pressure casing
42 High-pressure cylindrical portion
43 High-pressure lid portion
44 High-pressure gas inlet portion
45 High-pressure gas outlet portion
46 High-pressure heat exchange unit
46*a* High-pressure demister
47 Connection portion
48 Cover
49 Base plate
O1 Center axis
O2 Center axis
03 Center axis
L1 Length of low-pressure casing
R1 Diameter of low-pressure casing
F1 Length of low-pressure heat exchanger in gas flow direction
L2 Length of high-pressure casing
R2 Diameter of high-pressure casing
F2 Length of high-pressure heat exchanger in gas flow direction
F3 Length of high-pressure heat exchanger in gas flow direction
D Front and rear direction
H Up and down direction
W Width direction

What is claimed is:

1. A compressor module comprising:

a compressor; and a high-pressure gas cooler configured to cool gas discharged from the compressor, wherein the high-pressure gas cooler comprises at least two gas cooler split bodies, each of the two gas cooler split bodies comprises:

a high-pressure casing that is formed in a cylindrical container shape extending in a horizontal direction and to which the gas is introduced; and a high-pressure heat exchange unit that:

comprises heat transfer tubes disposed in the high-pressure casing and extending in a direction of a center axis of the high-pressure casing, and is configured to cool gas passing through the heat transfer tubes in a single direction orthogonal to the center axis of the high-pressure casing, the two gas cooler split bodies are disposed in parallel such that respective center axes of high-pressure casings of the two gas cooler split bodies are parallel to each other, the gas sequentially flows through the two gas cooler split bodies, the high-pressure gas cooler further comprises a straight tubular-shaped connection portion disposed between the two gas cooler split bodies and connecting the two gas cooler split bodies such that the gas, flowing from an upstream side gas cooler split body of the two gas cooler split bodies to a downstream side gas cooler split body of the two gas cooler split bodies via the straight connection portion, flows in the single direction, the upstream side gas cooler split body comprises a gas inlet portion through which the gas is introduced from the compressor, the downstream side gas cooler split body comprises a gas outlet portion through which the gas is discharged to an outside of the downstream side gas cooler split body, and when viewed perpendicular to a direction of the center axes of the high-pressure casings of the two gas cooler split bodies, the gas inlet portion and the gas outlet portion overlap the straight tubular-shaped connection portion.

2. The compressor module according to claim 1, wherein the compressor comprises:

a low-pressure stage that is configured to compress gas introduced from an outside of the compressor module; and a high-pressure stage that is configured to further compress the gas compressed by the low-pressure stage, the high-pressure gas cooler cools the gas discharged from the high-pressure stage, the compressor module further comprises a low-pressure gas cooler that is configured to cool the gas discharged from the low-pressure stage and then introduced into the high-pressure stage, and the low-pressure gas cooler comprises:

a low-pressure casing that is formed in a cylindrical container shape extending in a horizontal direction and into which the gas is introduced; and a low-pressure heat exchange unit disposed in the low-pressure casing and configured to cool gas passing in the single direction orthogonal to a center axis of the low-pressure casing.

3. The compressor module according to claim 2, wherein, in the direction of the center axes of the high-pressure casings, a length of each of the high-pressure casings of the center axis of the high pressure casing is equal to or shorter than a length of the low-pressure casing in a direction of the center axis of the low-pressure casing.

4. The compressor module according to claim 2, wherein a diameter of each of the high-pressure casings is equal to or smaller than a diameter of the low-pressure casing.

5. The compressor module according to claim 1, wherein the two gas cooler split bodies are disposed in parallel in a vertical direction.

6. The compressor module according to claim 2, wherein a value of D2/L2 is in a range of 0.4 to 0.7 where D2 is a diameter of the low-pressure casing and L2 is a length of the low-pressure casing.

7. The compressor module according to claim 1, wherein a value of D1/L1 is in a range of 0.4 to 0.7 where D1 is a diameter of the high-pressure casings and L1 is a length of the high-pressure casings.

* * * * *